US007070522B2

(12) United States Patent
Matwijw et al.

(10) Patent No.: US 7,070,522 B2
(45) Date of Patent: Jul. 4, 2006

(54) HOCKEY GOALTENDER SKATE BLADE PROTECTOR

(76) Inventors: Stan Matwijw, 42247 Joyce La., Novi, MI (US) 48377; Joe Messina, 5250 Annapolis La. North, Apt. 2305, Plymouth, MN (US) 55446

( * ) Notice: Subject to any disclaimer, the term of this patent is extended or adjusted under 35 U.S.C. 154(b) by 46 days.

(21) Appl. No.: 10/832,911

(22) Filed: Apr. 27, 2004

(65) Prior Publication Data

US 2005/0239582 A1 Oct. 27, 2005

(51) Int. Cl.
*A63B 63/00* (2006.01)

(52) U.S. Cl. ..... 473/478; 473/476

(58) Field of Classification Search ..... 473/478, 473/197, 462, 456, 494, 476; 403/205; 4/558; 40/658

See application file for complete search history.

(56) References Cited

U.S. PATENT DOCUMENTS 2,470,811 A * 5/1949 Engleman ..... 40/658
3,297,817 A * 1/1967 Stier ..... 174/87
3,322,381 A * 5/1967 Bubb ..... 248/121
3,669,491 A * 6/1972 Westlock ..... 297/248
3,856,298 A 12/1974 Frantti
4,579,344 A 4/1986 Meggs
4,619,456 A 10/1986 Meggs
5,170,974 A * 12/1992 Ruggiero ..... 248/251
5,328,652 A 7/1994 Thomson
5,561,870 A * 10/1996 Hertel ..... 4/609
5,611,533 A * 3/1997 Williams ..... 473/568

* cited by examiner

*Primary Examiner*—Stephen Blau
*Assistant Examiner*—M. Chambers
(74) *Attorney, Agent, or Firm*—Gifford, Krass, Groh, Sprinkle, Anderson & Citkowski, P.C.

(57) ABSTRACT

A hockey goaltender skate blade protector for use in conjunction with a hockey goal net is provided. The skate blade protector includes a main body portion having a cylindrical shape. The main body portion includes a bore extending longitudinally therethrough a center portion, and a longitudinally extending post receiving opening formed in a wall of the main body portion. The skate blade protector further includes a gripping means integral with the main body portion for installing the main body portion onto a hockey net goal post and removing the main body portion from the goal post.

26 Claims, 3 Drawing Sheets

HOCKEY GOALTENDER SKATE BLADE PROTECTOR

BACKGROUND OF THE INVENTION

1. Field of the Invention

The present invention relates generally to ice hockey equipment, and more specifically, to a hockey goaltender skate blade protector.

2. Description of the Related Art

Ice hockey is a sport played at a wide range of levels, from recreational to professional. The object of the game is to shoot a puck into the other team's goal net. The player positions include forward, defense and goaltender. The goaltender is the last line of defense in keeping the opposing team's puck out of the goal net. Ice hockey players wear protective equipment due to the rigors of the sport. The goaltender, in particular, wears specialized protective equipment, due to the uniqueness of the position. The goaltender helmet, neck guard, and chest protector are all designed to protect the player's body. At the same time, the glove and blocker and kneepads are all designed to assist the goaltender in stopping the puck. The goaltender also wears a unique ice skate designed for the position. The boot portion of the skate has a lower profile, and there is a protective guard surrounding a lower portion of the boot. The blade is wider to accommodate the lateral movement of the goaltender. The goaltender utilizes various stylistic maneuvers to defend the net and to stop the puck. Examples of these techniques include a butterfly, butterfly slide, pad stack, shuffle, or half split, or the like.

In defending the net, the goaltender must shuffle quickly from post to post. During a game, the goaltender will frequently keep the edge of their skate against the post, in order to prevent the puck from entering the net. In order to develop this skill, the goaltender engages in drills to perfect their positioning, speed and agility during practice sessions. However, a problem with many of the drills that a goaltender practices is that repeated contact between the skate blade and the goal post may occur. Since the goal post is made of metal, repeated contact of the skate blade with the metal post tends to dull or nick the skate blade, which affects the skating ability of the goaltender. As a result, the blade must be sharpened. The need to resharpen the blade can be inconvenient and/or costly, especially when it occurs during a pregame practice.

Roller hockey is similar to ice hockey, except that it is played on a hard surface, and the players wear roller hockey skates. Roller hockey skates include a boot, similar to an ice hockey boot. The roller hockey skate also includes a plurality of wheels arranged in a predetermined pattern, such as in-line. The goaltender performs similar moves to an ice hockey goaltender, and may have related concerns regarding the skate wheels being damaged from repeated contact with the posts of the hockey net.

Thus, there is a need in the art for a protective device that is selectively installed on the goal post portion of the goal net during practice sessions to protect the blade portion of the goaltender's skate.

SUMMARY OF THE INVENTION

Accordingly, the present invention is a goaltender skate blade protector for use in conjunction with a hockey goal net. The skate blade protector includes a main body portion having a cylindrical shape. The main body portion includes a bore extending longitudinally therethrough a center portion, and a longitudinally extending post receiving opening formed in a wall of the main body portion. The skate blade protector further includes a gripping means integral with the main body portion for installing the main body portion onto a hockey net goal post and removing the main body portion from the goal post.

One advantage of the present invention is that a goaltender skate blade protector is provided that fits on the lower portion of the goal post in order to protect the skate blade of the goaltender's skate. Another advantage of the present invention is that a goaltender skate blade protector is provided that is easily inserted onto and removed from the goal post. Still another advantage of the present invention is that a goaltender skate blade protector is provided that is made from a material that will not nick or dull the skate blade. A further advantage of the present invention is that a goaltender skate blade protector is provided that is cost effective to manufacture.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
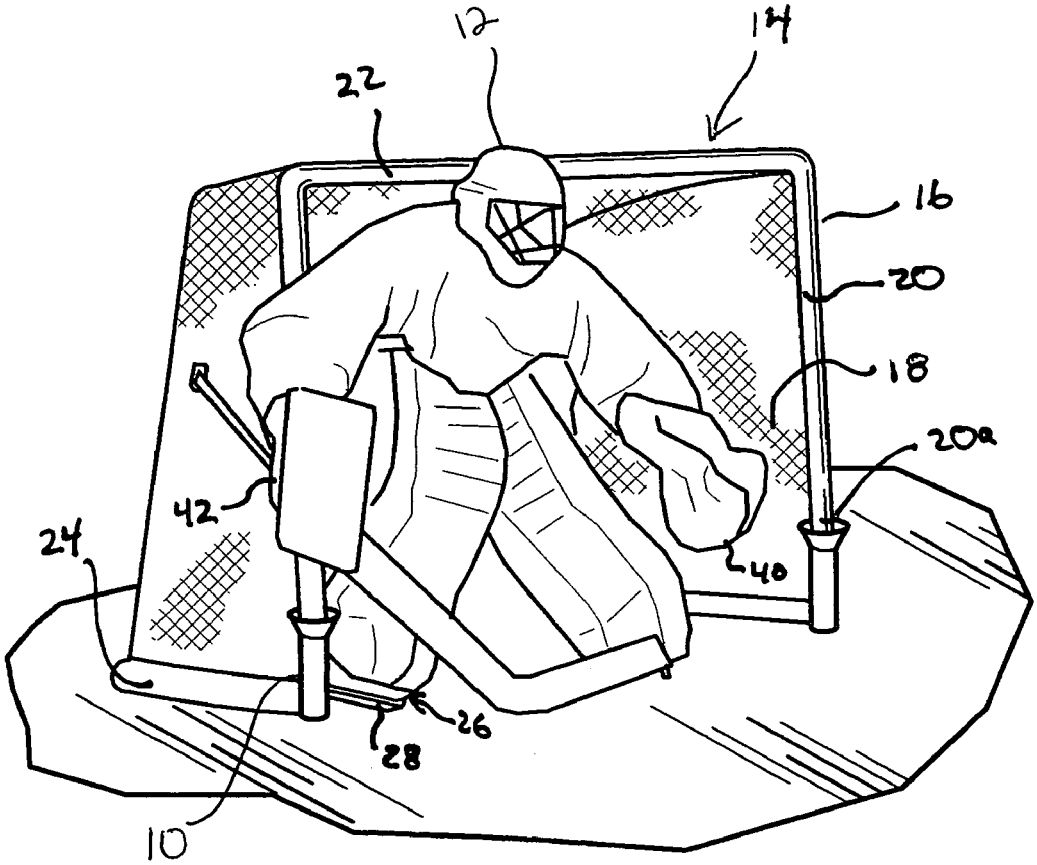
FIG. 1 is a perspective view of goaltender skate blade protector installed on a goal post, according to the present invention.
Figure 2:
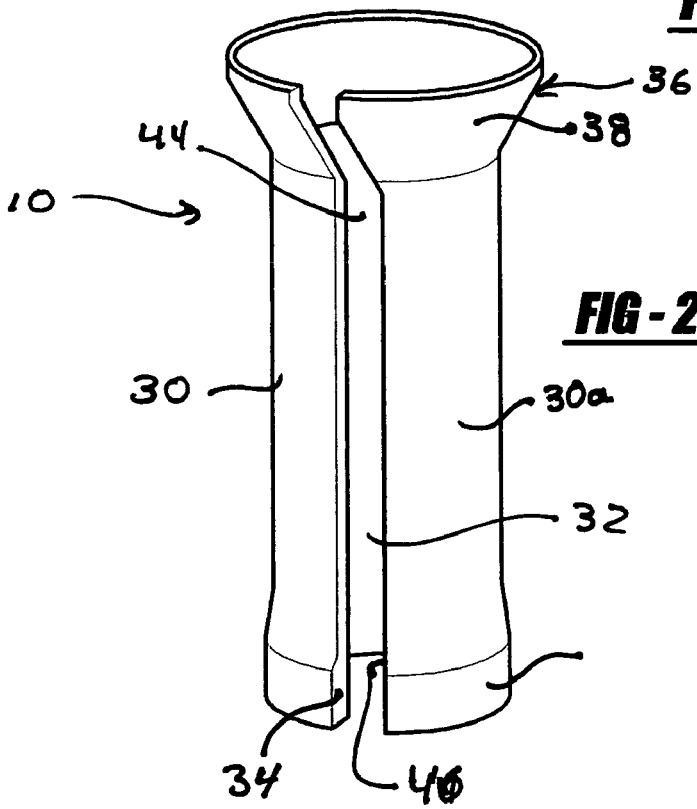
FIG. 2 is a perspective view of the goaltender skate blade protector of FIG. 1, according to the present invention.

Referring to FIGS. 1 and 2, a goaltender skate blade protector 10 is illustrated. It should be appreciated that in this example the goaltender skate blade protector 10 is utilized in conjunction with the sport of ice hockey, although use in other similar sports is contemplated.

The goaltender skate blade protector 10 is utilized in conjunction with a hockey goal net 14. The goal net 14 includes a frame portion 16 and a net portion 18, as is known in the art. The frame portion 16 is made of a steel material. The frame portion 16 includes two opposed post members 20 that are vertically oriented, an upper cross member 22 connected between the upper end of the each post member 20 that is horizontally oriented, and a substantially U-shaped lower member 24 connected between the lower ends 20*a* of each post member 20. The net portion 18 is made from a fabric mesh material, and is attached to the opposed post members 20, upper cross member 22 and lower member 24, to form an integral goal net 14.

A hockey goaltender 12 is typically positioned in front of the goal net 14, between the post members 20. The hockey goaltender 12 wears an ice skate 26 especially designed for his unique position, as previously described. The blade portion 28 of the ice skate 26 is advantageously protected by the goaltender skate blade protector 10 as the goaltender 12 moves around the crease in deflecting hockey pucks that are shot into the goal net 14.

As shown in FIG. 2, the goaltender skate blade protector 10 includes a main body portion 30 that is cylindrical in shape. The body portion 30 includes a centrally located bore 32. In this example, the main body portion 30 is about nine inches long. Preferably, the circumference is slightly less than the circumference of the post member 20, in order to have an interference fit. A lower end of the body portion 30 may include a section that is thicker in cross-sectional shape than the other areas, as shown at 34. The thicker lower end advantageously assists in retaining the main body portion 30 on the goal post member 20.

The goaltender skate blade protector 10 is preferably made from an elastomeric material. One example of a suitable material is plastic. Another example of a suitable material is polypropylene. Other types of material are contemplated. It should be appreciated that the selected material has to be insensitive to the temperature extremes that the skate blade protector 10 may be used subjected to, both on and off the ice.

The goaltender skate blade protector 10 includes a gripping means 36. In this example, the gripping means 36 is a flange 38 extending upwardly from an upper edge of the body portion 30, and flaring outwardly in a radial direction. It should be appreciated that the body portion 30 and flange 38 are integral and formed as one member. The height and radial angle of the flange 38 is selected so that the flange 38 can be gripped by the goaltender 12 while wearing a glove 40 or blocker 42. In this example, the flange 38 is at least two inches long.

Figure 5:
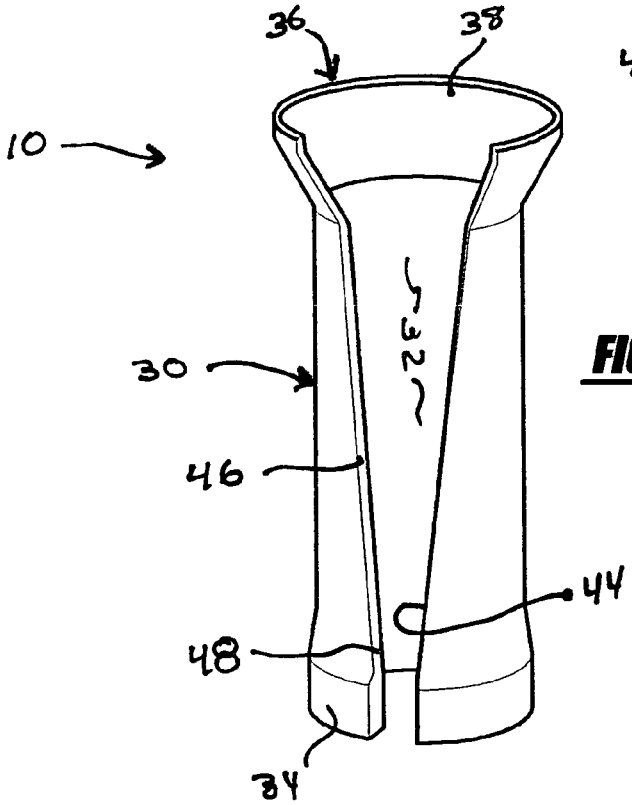
FIG. 5 is a perspective view of still yet another embodiment of the goaltender skate blade protector of FIG. 1, according to the present invention.

The goaltender skate blade protector 10 also includes a post receiving opening extending longitudinally through both the body portion 30 and the flange 38, as shown at 44. It should be appreciated that the edges 46 of the post-receiving opening 44 may be parallel. Alternatively, a lower or an upper edge of the post-receiving opening may converge, so that the opening is tapered, as shown in FIG. 5 at 48. The width of the post-receiving opening is selected to allow for ease of installation and removal of the skate blade protector 10 on the goal post member 20, while not compromising its ability to be retained on the post member 20.

Figure 3:
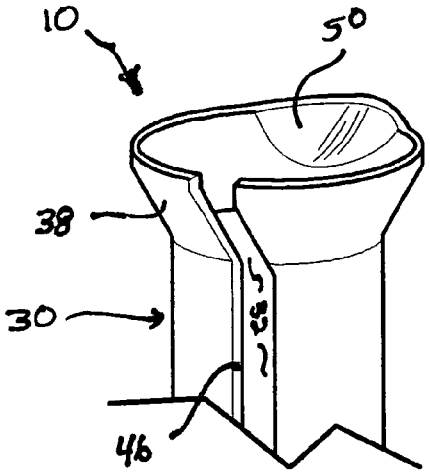
FIG. 3 is a perspective view of another embodiment of the goaltender skate blade protector of FIG. 1, according to the present invention.

In an alternative embodiment shown in FIG. 3, the gripping means 36 is an indentation 50 integrally formed in a surface of the skate blade protector 10. In this example, the indentation 50 is formed on the flange 38. It is also contemplated that the indentation 50 may be formed in the main body portion 30.

Figure 4:
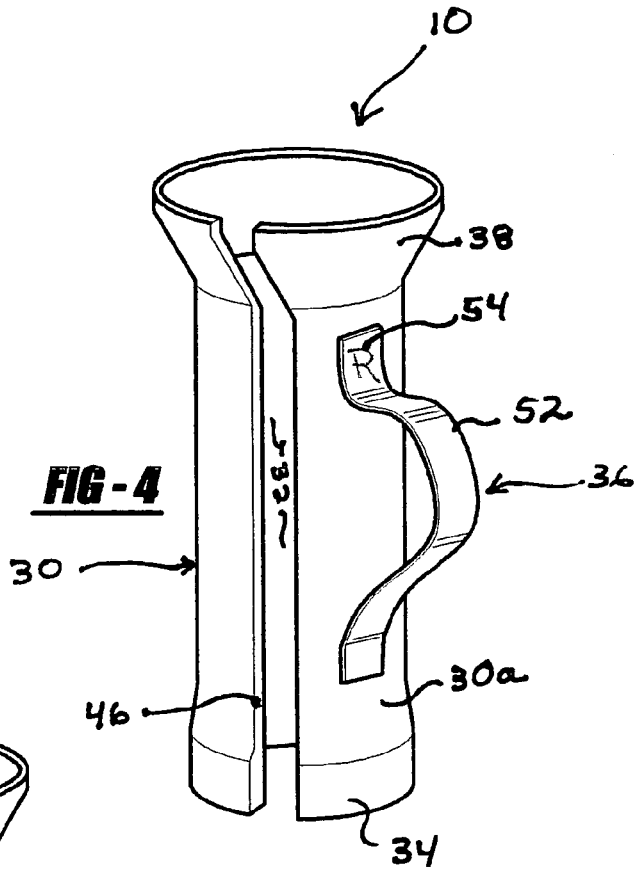
FIG. 4 is a perspective view of yet another embodiment of the goaltender skate blade protector of FIG. 1, according to the present invention.

In still another embodiment shown in FIG. 4, the gripping means 36 is a handle 52. While this example shows a flange 38 with the handle gripping means, it is contemplated that a flange 38 is not necessary. In this example, the handle 52 is positioned on an outer surface 30*a* of the main body portion 30. The handle 52 is strategically positioned so that it does not interfere with the skate blade 28 while installed on the hockey goal post member 20. For example, the handle 52 is positioned near the goal post opening 44 on the main body portion 30. The handle 52 may be positioned adjacent the right-hand side of the goal post opening 44, or adjacent the left-hand side. It should be appreciated that the goaltender 12 would have each a goaltender skate blade protector 10 with a right-hand handle 52 for the right goal post member 20, and a goaltender skate blade protector 10 with a left-hand handle 52 for the left goal post member 20. The goaltender skate blade protector 10 is preferably installed on the goal post member 20 in such a way that the handle 52 is located outside the goal net 14. In this example, the goal skate blade protector 10 may include an indicia 54 showing that the goaltender skate blade protector 10 is installed on the right goal post member 20, or left goal post member 20, as appropriate.

These are several examples of gripping means 36, and other types of gripping means are certainly foreseeable. It is further contemplated that the skate blade protector 10 may include more than one type of gripping means 36.

Figure 6:
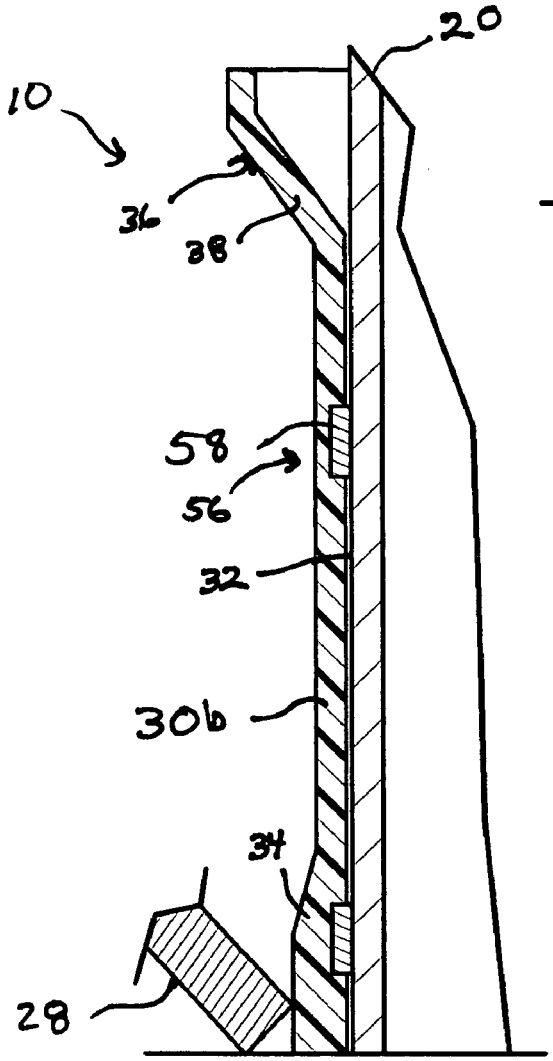
FIG. 6 is a side sectional view of a further embodiment of the goaltender skate blade protector of FIG. 1, according to the present invention.
Figure 7:
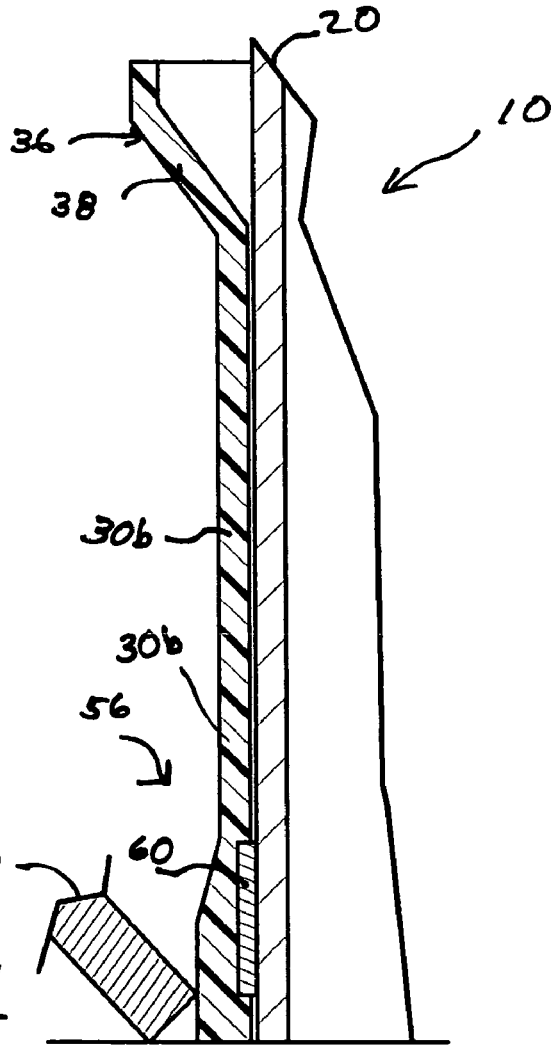
FIG. 7 is a side sectional view of yet a further embodiment of the goaltender skate blade protector of FIG. 1, according to the present invention.

In a further embodiment, shown in FIGS. 6 and 7, the goaltender skate blade protector 10 includes a retaining means 56 for fixedly retaining the position of the skate blade protector 10 on the goal post member 20. As shown in FIG. 6, the retaining means 56 is a metal band 58 embedded in an inner surface 30*b* of the main body portion 30. The metal band 58 is preferably positioned near the lower end of the main body portion 30. A second band 58 may be positioned near the upper end of the main body portion 30. The metal band 58 has a memory feature, like a spring, and assists in rigidly retaining the goaltender skate blade protector 10 in the desired position on the goal post member 20.

Alternatively, the retaining means 58 is a magnetized member 60 imbedded in an inner surface 30*b* of the main body portion 30. The magnetized member 60 is preferably positioned near the lower end of the main body portion 30. A second magnetized member may also be positioned near the upper end of the main body portion 30. The magnetized member 60 functionally retains the goaltender skate blade protector 10 in the desired position on the goal post member 20. Preferably, the magnetized member 60 is made from a material with is magnetic properties.

In operation, to install the skate blade protector 10 on the goal post member 20, the goaltender 12 grasps the gripping means 36, aligns the post opening 44 of the main body portion 30 with the lower end of the goal post member 20, and pushes the main body portion 30 onto the post member 20. The goaltender 12 may laterally adjust the main body portion 30 so that the net portion 18 of the goal net 14 is disposed between the edges 46 of the post opening 44. The goaltender skate blade protector 10 preferably include a post retaining means 56 to further assist in keeping the protector in the desired position. To remove the goaltender skate blade protector 10 from the goal post member 20, the goaltender 12 grasps the gripping means 36 and pulls the main body portion 30 away from the goal post member 20. The goaltender skate blade protector 10 advantageously retains its shape to allow for repeated use.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A hockey goaltender skate blade protector for use in conjunction with a hockey goal net having a goal post to prevent contact with the goal post by a goaltender skate blade, said skate blade protector comprising:

a main body portion having a cylindrical shape, wherein said main body portion includes a wall, a bore extending longitudinally therethrough a center of said main body portion, and a longitudinally extending post receiving opening formed in the wall of said main body portion; and a gripping means integral with said main body portion for holding said skate blade protector by a goaltender while installing said main body portion around a hockey net goal post to prevent contact with the goal post by the goaltender skate blade and removing said main body portion from the goal post.

2. The skate blade protector of claim 1 wherein said gripping means is an integrally formed flange extending upwardly and radially outwardly from an upper end of the wall of said main body portion.

3. The skate blade protector of claim 1 wherein said gripping means is an indentation integrally formed in the wall of said main body portion.

4. The skate blade protector of claim 1 wherein said gripping means is a handle integrally formed with said main body portion.

5. The skate blade protector of claim 4 wherein said handle is positioned on an outer wall of said main body portion near the post receiving opening formed in the wall of said main body portion.

6. The skate blade protector of claim 1 further comprising a retaining means for retaining said main body portion around the goal post.

7. The skate blade protector of claim 6 wherein said retaining means is a magnetized member embedded in an inner portion of the wall of said main body portion.

8. The skate blade protector of claim 6 wherein said retaining means is a metal band imbedded in an inner portion of the wall of said main body member.

9. The skate blade protector of claim 1 wherein a lower end of the wall of said main body portion is thicker in cross-sectional shape than an upper end.

10. The skate blade protector of claim 1 wherein a circumference of said main body portion is less than a circumference of the goal post.

11. The skate blade protector of claim 1 wherein the edges of said post receiving opening in the wall of the main body portion are parallel.

12. The skate blade protector of claim 1 wherein the edges of said post receiving opening in the wall of the main body portion converge.

13. A hockey goaltender skate blade protector for use in conjunction with a hockey goal net having opposed, vertically oriented posts to prevent contact with the goal post by a goaltender skate blade, said skate blade protector comprising:

a main body portion having a cylindrical shape, wherein said main body portion is made from an elastomeric material and includes a wall and a bore extending longitudinally therethrough a center of said main body portion, and a longitudinally extending post receiving opening formed in the wall of said main body portion;

a gripping means integral with said main body portion for holding said skate blade protector by a goaltender while installing said main body portion around the hockey net goal post to prevent contact with the goal post by the goaltender skate blade and removing said main body portion from the goal post; and a retaining means integral with said main body portion for retaining said main body portion around the goal post.

14. The skate blade protector of claim 13 wherein said gripping means is an integrally formed flange extending upwardly and radially outwardly from an upper end of the wall of said main body portion.

15. The skate blade protector of claim 13 wherein said gripping means is an indentation integrally formed in the wall of said main body portion.

16. The skate blade protector of claim 13 wherein said gripping means is a handle integrally formed with said main body portion.

17. The skate blade protector of claim 16 wherein said handle is positioned on an outer wall of said main body portion near the post receiving opening formed in the wall of said main body portion.

18. A hockey goaltender skate blade protector for use in conjunction with a hockey goal net having opposed, vertically oriented posts, said skate blade protector comprising:

a main body portion having a cylindrical shape, wherein said main body portion includes a wall and a bore extending longitudinally therethrough a center of said main body portion, and a longitudinally extending post receiving opening formed in the wall of said main body portion;

a gripping means integral with said main body portion for holding said skate blade protector while installing said main body portion around a hockey net goal post and removing said main body portion from the goal post; and a retaining means integral with said main body portion for retaining said main body portion around the goal post, wherein said retaining means is a magnetized member embedded in an inner portion of the wall of said main body portion.

19. A hockey goaltender skate blade protector for use in conjunction with a hockey goal net having opposed, vertically oriented posts, said skate blade protector comprising:

a main body portion having a cylindrical shape, wherein said main body portion includes a wall and a bore extending longitudinally therethrough a center of said main body portion, and a longitudinally extending post receiving opening formed in the wall of said main body portion;

a gripping means integral with said main body portion for holding said skate blade protector while installing said main body portion around a hockey net goal post and removing said main body portion from the goal post; and a retaining means integral with said main body portion for retaining said main body portion around the goal post, wherein said retaining means is a metal band imbedded in an inner portion of the wall of said main body member.

20. The skate blade protector of claim 13 wherein a lower end of the wall of said main body portion is thicker in cross-sectional shape than an upper end.

21. The skate blade protector of claim 13 wherein a circumference of said main body portion is less than a circumference of the goal post.

22. The skate blade protector of claim 13 wherein the edges of said post receiving opening in the wall of the main body portion are parallel.

23. The skate blade protector of claim 13 wherein the edges of said post receiving opening in the wall of the main body portion converge.

24. A hockey goaltender skate blade protector for use in conjunction with a hockey goal net having opposed, vertically oriented posts to prevent contact with the goal post by a goaltender skate blade, said skate blade protector comprising:

a main body portion having a cylindrical shape, wherein said main body portion is made from an elastomeric material and includes a wall and a bore extending longitudinally therethrough a center of said main body portion, and a longitudinally extending post receiving opening formed in the wall of said main body portion and a circumference of said wall is less than a circumference of the goal post member, and a lower end of the wall of said main body portion is thicker in cross-sectional shape than an upper end;

a gripping means integral with said main body portion for holding said skate blade protector by a goaltender while installing said main body portion around the hockey net goal post to prevent contact with the goal post by the goaltender skate blade and removing said main body portion from the goal post, wherein said gripping means is an integrally formed flange extending upwardly and radially outwardly from an upper end of the wall of said main body portion; and a retaining means integral with said main body portion for retaining said main body portion around the goal post.

25. The skate blade protector of claim 24 wherein said retaining means is a magnetized member embedded in an inner portion of the wall of said main body portion.

26. The skate blade protector of claim 24 wherein said retaining means is a metal band imbedded in an inner portion of the wall of said main body member.

* * * * *